US011718427B1

(12) United States Patent
Bradshaw

(10) Patent No.: US 11,718,427 B1
(45) Date of Patent: Aug. 8, 2023

(54) VOLUMETRIC ISOBARIC FILLING SYSTEM

(71) Applicant: Vital Manufacturing Inc., Port Coquitlam (CA)

(72) Inventor: Joshua Richard Bradshaw, Maple Ridge (CA)

( * ) Notice: Subject to any disclaimer, the term of this patent is extended or adjusted under 35 U.S.C. 154(b) by 0 days.

(21) Appl. No.: 17/842,799

(22) Filed: Jun. 17, 2022

Related U.S. Application Data

(60) Provisional application No. 63/337,127, filed on May 1, 2022.

(51) Int. Cl.

| | |
|---|---|
| ***B65B 3/32*** | (2006.01) |
| ***B65B 3/12*** | (2006.01) |
| ***B65B 37/06*** | (2006.01) |
| ***B65B 31/04*** | (2006.01) |

(52) U.S. Cl.
CPC ..... *B65B 3/32* (2013.01); *B65B 3/12* (2013.01); *B65B 31/04* (2013.01); *B65B 37/06* (2013.01)

(58) Field of Classification Search
CPC .... B65B 3/32; B65B 3/12; B65B 3/26; B65B 3/04; B65B 31/04; B65B 37/06
See application file for complete search history.

(56) References Cited

U.S. PATENT DOCUMENTS 2,808,856 A * 10/1957 Tiano ..... B67C 3/16 141/59
3,023,791 A * 3/1962 Strain ..... B65B 3/12 141/270
3,491,369 A * 1/1970 Debbrecht ..... G01F 11/04 96/105
4,798,235 A * 1/1989 Torterotot ..... B65B 3/32 141/286
5,372,167 A * 12/1994 Hirose ..... B67C 3/26 141/181
5,524,683 A * 6/1996 Mueller ..... B65B 3/32 141/261
6,095,206 A * 8/2000 Jones ..... H01M 50/673 141/35
8,109,299 B2 * 2/2012 Lupi ..... B67C 3/2625 141/144
8,381,777 B2 * 2/2013 Lupi ..... B67C 3/2617 141/144
9,242,848 B2 * 1/2016 Murray ..... B65B 39/145
9,505,511 B2 * 11/2016 Murray ..... B65B 31/044
10,040,582 B2 * 8/2018 Gai ..... B67C 3/262
(Continued)

FOREIGN PATENT DOCUMENTS

EP 375912 A * 7/1990 ..... B65B 3/04
EP 3357817 A1 * 8/2018 ..... B65B 3/04

*Primary Examiner* — Nicolas A Arnett
(74) *Attorney, Agent, or Firm* — Dwayne E Rogge; Puget Sound Patents

(57) ABSTRACT

A new fluid fill piston pump device comprising a piston chamber defined by an inner surface. Inside this piston chamber is an oscillating piston having an outer surface forming a sliding seal to the inner surface of the piston chamber. The oscillating piston separates the piston chamber into a gas chamber and a fluid chamber such that the sum of the two chambers remains the same as the piston oscillates changing the volume of the two chambers in opposition. As fluid is pumped into the container from the fluid chamber of the piston chamber, gas is drawn from the container into the gas chamber in the same action.

8 Claims, 4 Drawing Sheets

(56) References Cited

U.S. PATENT DOCUMENTS

| | | | | |
|---|---|---|---|---|
| 10,159,784 | B2 * | 12/2018 | Teutsch | A61M 5/14244 |
| 10,836,622 | B2 * | 11/2020 | Meinzinger | B67C 3/225 |
| 2001/0045242 | A1 * | 11/2001 | Clusserath | B67C 3/007<br>141/144 |
| 2016/0016774 | A1 * | 1/2016 | Clusserath | B67C 3/10<br>141/7 |
| 2016/0025267 | A1 * | 1/2016 | Clüsserath | B67C 3/2617<br>141/4 |

* cited by examiner

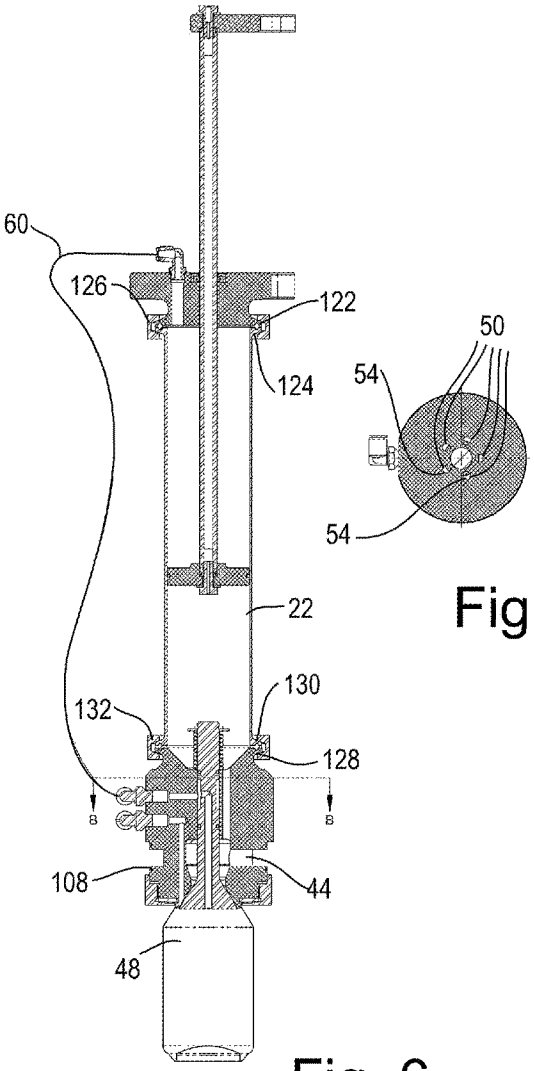
Fig. 7
Fig. 6
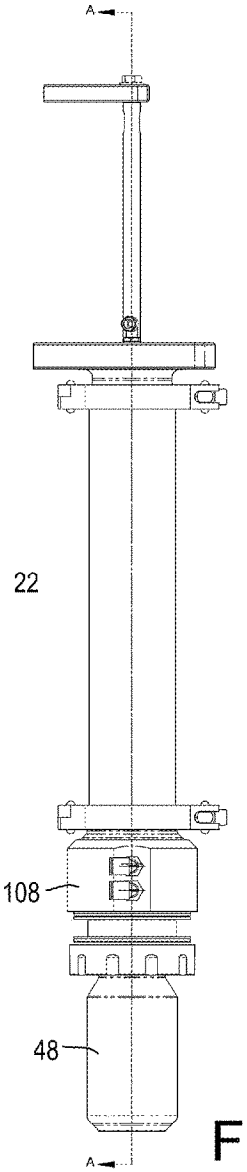
Fig. 5
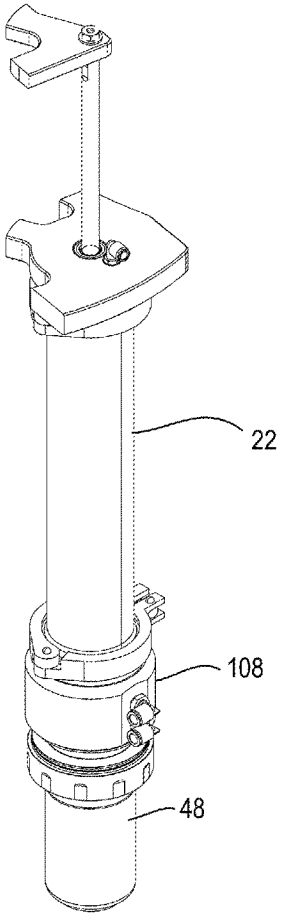
Fig. 4

VOLUMETRIC ISOBARIC FILLING SYSTEM

RELATED APPLICATIONS

This application claims priority of U.S. Provisional Patent Application Ser. No. 63/337,127 filed on May 1, 2022, incorporated herein by reference.

BACKGROUND OF THE DISCLOSURE

Field of the Disclosure

This disclosure relates to the field of fill devices used to fill the said container with a fluid. Such fluids include beverages including carbonated beverages such as soft drinks, juices, seltzer water, flavored soda pop, beer, etc.

BRIEF SUMMARY OF THE DISCLOSURE

In the prior art, it is well known to bring a beverage container such as a can or bottle in proximity to a fill device to fill the container with a desired fluid such as carbonated beverages. In such processes, it is often desired to add an inert gas such as nitrogen or carbon dioxide into the container prior to filling to purge air within the container which may be detrimental to the container and/or fill fluid. This inert (purge) gas purges oxygen and other undesired gasses from the beverage container prior to filling the container with the desired fluid. During each iteration of this purge process, the inert gas is often spilled and lost to the environment. Similarly, when the fluid is inserted into the container, any inert gas purged by the fluid is lost to the environment. While this loss is a common and accepted practice due to the low materials cost of most inert gasses, it is desired to reduce waste, reduce the carbon footprint of the filling process (e.g., when CO2 is used as the purge gas) and capture and reuse the inert gasses used in the purging process. Traditionally the cost of such recapture outweighed the benefits and thus were not enacted.

By utilizing an isobaric system, the volume of the chambers is changed to accommodate the volume of pump gas, liquid, and potentially other fluids. In addition, the speed efficiency and accuracy of the fill process can be optimized.

Disclosed herein is a new fluid-fill, piston pump device comprising a piston chamber defined by an inner surface. Inside this piston chamber is an oscillating piston having an outer surface forming a sliding seal to the inner surface of the piston chamber. The oscillating piston separates the piston chamber into a gas chamber and a fluid chamber such that the sum of the two chambers' volumes remains the same as the piston oscillates. This oscillation changes the volume of the two chambers in opposition.

To increase efficiency, also disclosed is an external source of fill fluid connected via a fill fluid conduit to the fluid chamber of the piston chamber to replace any lost purge gas.

A releasable sealing surface is attached to the fluid chamber or valve assembly. This sealing surface forms a fluid seal between the pump device and a fluid container removably sealed to the pump device during the purging/filling process. When the purge/fill processes are in operation, the container may be sealed to the pump device and then released for the use with a subsequent container. Also disclosed is a container fill conduit connecting the fluid chamber and the fluid container. As the volume of the fluid chamber is reduced by the piston, the fluid flows to the fluid container. Between these structures (the fluid chamber and the fluid container) is positioned a fluid fill valve configured to selectively close the container fill conduit as the oscillating piston is increasing the volume of the fluid chamber. Also disclosed is a gas conduit connecting the gas chamber and the fluid container. A gas valve is positioned along this conduit. The gas valve is configured to open the gas conduit as the oscillating piston is increasing the volume of the gas chamber. In this way, as fluid is pumped into the fluid container from the fluid chamber, gas is drawn from the container to the gas chamber. The (first) container is then released, a (second) container is then attached to the container seal. The piston then oscillates to reduce the volume of the gas chamber. The gas contained therein is then pumped into the (second) container as fluid is drawn into the fluid chamber via the source of fluid. The process is then repeated.

Also disclosed is a source of inert (purge) gas. During the purge/fill/capture/repeat process, some of the purge gas may be lost to the environment and must be replenished. Periodically gas is drawn from the source of inert gas to the gas chamber as needed. For this purpose, a purge gas conduit connecting the source of inert gas and the inert gas chamber is provided along with a purge gas valve selectively configured to close the purge gas conduit.

Periodically air, gas, etc. may develop in the upper region (head) of the fluid chamber. As this may be a detriment to the fill fluid, it should be removed. For this purpose, the fluid fill device may also include a selectively closeable gas vent near the upper edge of the fluid chamber. This gas vent may comprise a conduit extending through the piston shaft described below.

The fluid fill device as described may include a piston shaft extending from the oscillating piston to a piston actuator. In one example the fluid fill device may be arranged wherein the gas vent extends through the piston shaft. To maintain integrity, the fluid fill device may include a selectively closeable gas vent valve, selectively closing the gas vent. The selectively closeable gas vent valve may comprise an electronic actuator.

The fluid fill device may be arranged wherein the fluid valve is a pressure-actuated spring valve with a normally closed position. This means that with no external forces acting thereon, the valve is closed. The fluid fill device may be arranged wherein the gas valve comprises an electronic actuator configured to open the gas valve.

BRIEF DESCRIPTION OF THE SEVERAL VIEWS OF THE DRAWINGS

FIG. 4 is an isometric view of one example of the disclosed apparatus.

FIG. 5 is a side view of one example of the disclosed apparatus.

FIG. 6 is a cutaway view of one example of the disclosed apparatus taken along the line A-A of FIG. 5.

FIG. 7 is a cutaway view of one example of the disclosed apparatus taken along the line B-B of FIG. 6.

DETAILED DESCRIPTION OF THE DISCLOSURE

Figure 1:
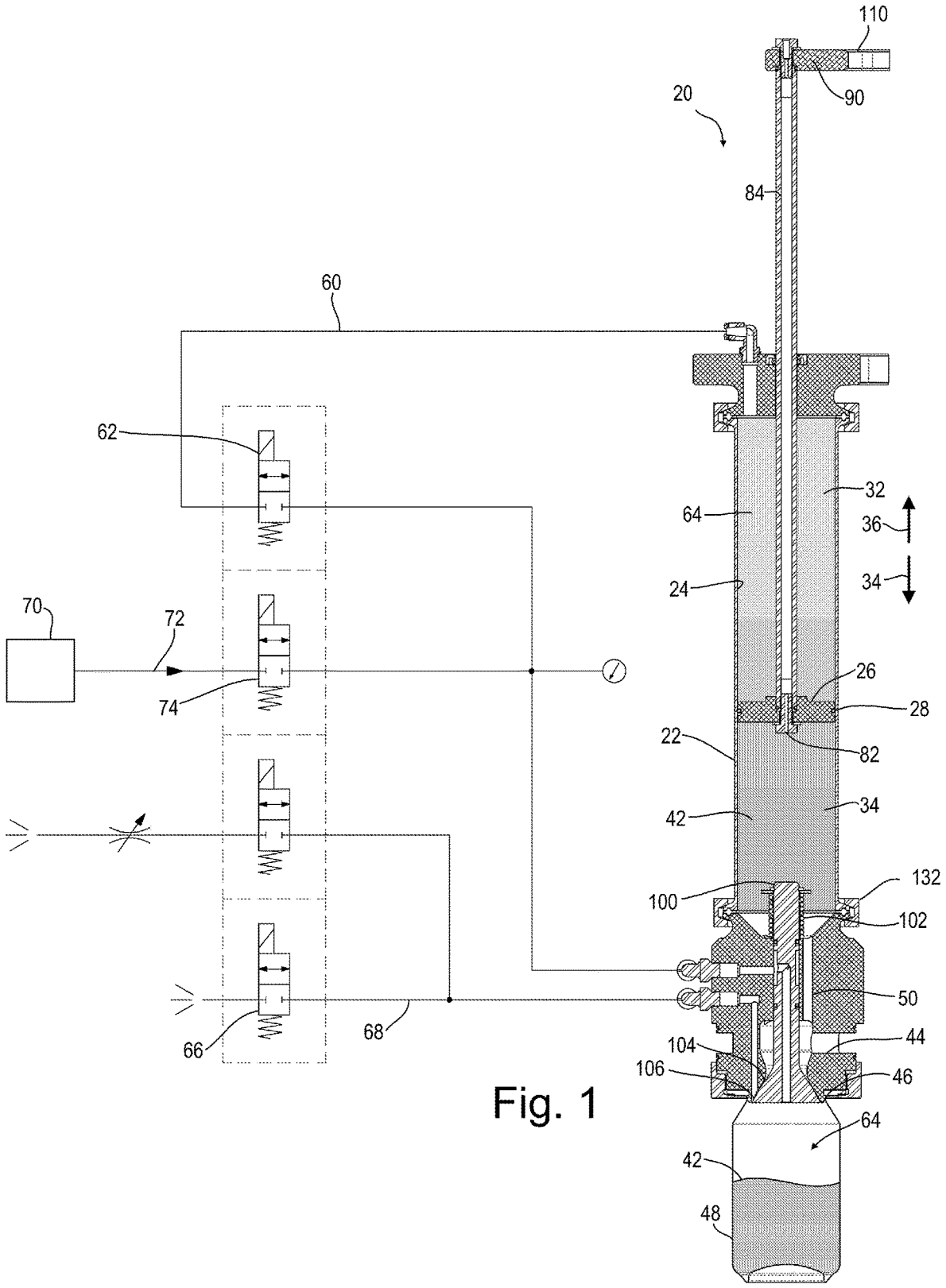
FIG. 1 is a sectional view of one example of the disclosed apparatus, disclosed herein.

Disclosed herein is a new fluid fill piston pump 20 configured to pump fluid from a fluid source into a container while simultaneously drawing purge gasses from the container. The piston pump device 20 in one example a piston chamber 22 defined by an inner surface 24. Inside this piston chamber 22 is an oscillating piston 26 having an outer surface 28 forming a sliding seal 30 to the inner surface 24 of the piston chamber. The oscillating piston 26 separates the piston chamber 22 into a gas chamber 32 and a fluid chamber 34 such that the sum of the two chambers 32/34 remains the same as the piston 26 oscillates changing the volume of the two chambers 32/34 in opposition. In other words, as the piston 26 moves in a first direction 36, the volume of the fluid chamber 34 increases, drawing fluid thereinto and simultaneously reducing the volume of the gas chamber 32 by the same volume, increasing the pressure therein slightly and pressing the gas out of the gas chamber. As the piston 26 moves in a second direction 38 the opposite occurs, the volume of the fluid chamber 34 decreases, drawing fluid thereinto and simultaneously increasing the volume of the gas chamber 32 by the same volume, pressing the fluid 42 out of the fluid chamber 34.

In operation, an external source 40 of fill fluid 42 is connected via a fill fluid conduit 44 to the fluid chamber 34 of the piston chamber 22. This fill fluid may be a consumable beverage.

To ensure a quick purge and fill cycle without spillage, a sealing surface 46 is attached to the fill device 20. This surface 46 forms a fluid seal between the fluid chamber 34 and a fluid container 48. The fluid container 48 thus removably sealed to the fill device 20 during the purge and fill process and released following this process. Also disclosed is a container fill conduit 50 connecting the fluid chamber and the fluid container such that as the volume of the fluid chamber 34 is reduced by the piston 26; the fluid 42 flows to the fluid container 48. Due to the pressure provided by the moving piston 26, the speed of the filling process is much greater than would be possible by gravity fill alone. Positioned between these structures 34/46 is a fluid fill valve 52 selectively configured to close the container fill conduit 50 as the oscillating piston 26 is increasing the volume of the fluid chamber 34. In one example, the container fill conduit comprises a plurality of surfaces defining cooperating tubes 54 as can be readily seen in FIG. 7. This arrangement of a plurality of tubes 54 increases the filling speed, and also increases the laminar flow of the fluid 42 therethrough, reducing turbulence as the container 48 is filled.

To recapture and reuse the purge gas, also disclosed is a gas conduit 60 connecting the gas chamber and the fluid container. The gas conduit 60 in one example provided with a gas valve 62 selectively configured to open the gas conduit 60 as the oscillating piston 26 is increasing the volume of the gas chamber 32. In this way, as pressurized fluid 42 is pumped into the fluid container 48 from the fluid chamber, gas 64 is drawn (pumped) from the container 48 to the gas chamber 32.

The (first) container 48 is then released from the container seal 46, removed from the fill device 20, and a subsequent (second) container 48 is then attached to the container seal 46. The piston 26 is then oscillated in the opposing direction to reduce the volume of the gas chamber 32, the gas 64 contained therein is then pumped into the (second) container 48 as fluid 42 is drawn into the fluid chamber 34 through the fluid inlet 44 from the source of fluid 40. This step purges any air or other undesired gas from the container 48 prior to filling. To accomplish this, an oxygen ($O_2$) vent valve 66 may be installed onto an oxygen vent conduit 68. This oxygen vent 66 may vent to the environment as the container 48 is generally filled with air prior to purging. The process is then repeated to fill the container 48.

During the process, it will be desired to replenish the volume of the inert gas 64. For this purpose, disclosed is a source of inert (purge) gas 70 connected to the gas chamber 32 via an inert gas inlet conduit 72. An inert gas inlet valve 74 may be provided along the conduit 72. During the purge/fill/capture/repeat process, some of the purge gas 70 may be lost to the environment and must be replenished. Periodically, inert gas 70 is drawn from the source of inert gas 70 to the gas chamber 32 as needed. For this purpose, a purge gas conduit connecting 72 the source of inert gas and the inert gas chamber 32 is provided along with a purge gas valve selectively configured to close the purge gas conduit.

Periodically air, gas, etc. may develop in the upper region (head) 80 of the fluid chamber 34. As this air may be a detriment to the fill fluid 42, it should be removed. For this purpose, the fluid fill device 20 may also include a selectively closeable gas vent 82 near the upper edge of the fluid chamber 34. As this upper edge may be movable when it corresponds to the position of the piston 26, this gas vent 82 may comprise a conduit 84 extending through a piston shaft 86 described below. Releasing the air from the fluid chamber 34 allows the apparatus to be stored in a filled configuration such as overnight or between shifts, reducing contamination and waste of the fill fluid 42.

The fluid fill device 20 as described may include a piston shaft 86 extending from the oscillating piston 26 to a piston actuator 88. In one example the fluid fill device 20 may be arranged wherein the gas vent 82 extends through the piston shaft 86. To maintain integrity, the fluid fill device may include a selectively closeable gas vent valve 90 selectively closing the gas vent 82.

The fluid fill device 20 may be arranged wherein the fluid valve 100 is a pressure-actuated spring valve with a normally closed position. "Normally closed" meaning that with no external forces acting thereon, the valve is closed such as by way of the disclosed compression spring 102 pressing a (conic) surface 104 of the moving valve structure against a cooperating surface 106 of the valve assembly 108. As the piston 26 moves to reduce the volume of the fluid chamber 34, the increasing pressure of the ill fluid 42 opens the valve 104, allowing the fluid to flow into the container 48. Thus, the fill fluid is directed to the inner walls of the container. In addition, the speed/pressure of the piston controls the speed at which the fill fluid is pumped into the container.

As understood from the drawings, each of the valves, in particular, valves 62, 66, 67, 72, 90, can be individually and remotely opened/closed via an attached actuator 110. These actuators 110 electrically or mechanically connected to the piston actuator 88 and other mechanical/electric apparatus allow for autonomous or remote processing of the purge/fill steps via circuitry and/or computer 112 with a program residing on non-transient media.

The piston chamber 22 is substantially a tube, and it may be periodically desired to clean the inner surface 24 thereof. Thus, in one example the piston chamber 22 may be attached to a cap 120 via a pair of flanges 122 and 124 on the cap 120 and piston chamber 22 respectively, with a securing clamp 126. Such securing clamps 126 are well known in other arts. Similarly in one example the piston chamber 22 may be attached to the valve assembly 108 via a pair of flanges 128 and 130 on the valve assembly 108 and piston chamber 22 respectively, with a similar securing clamp 132.

Figure 2:
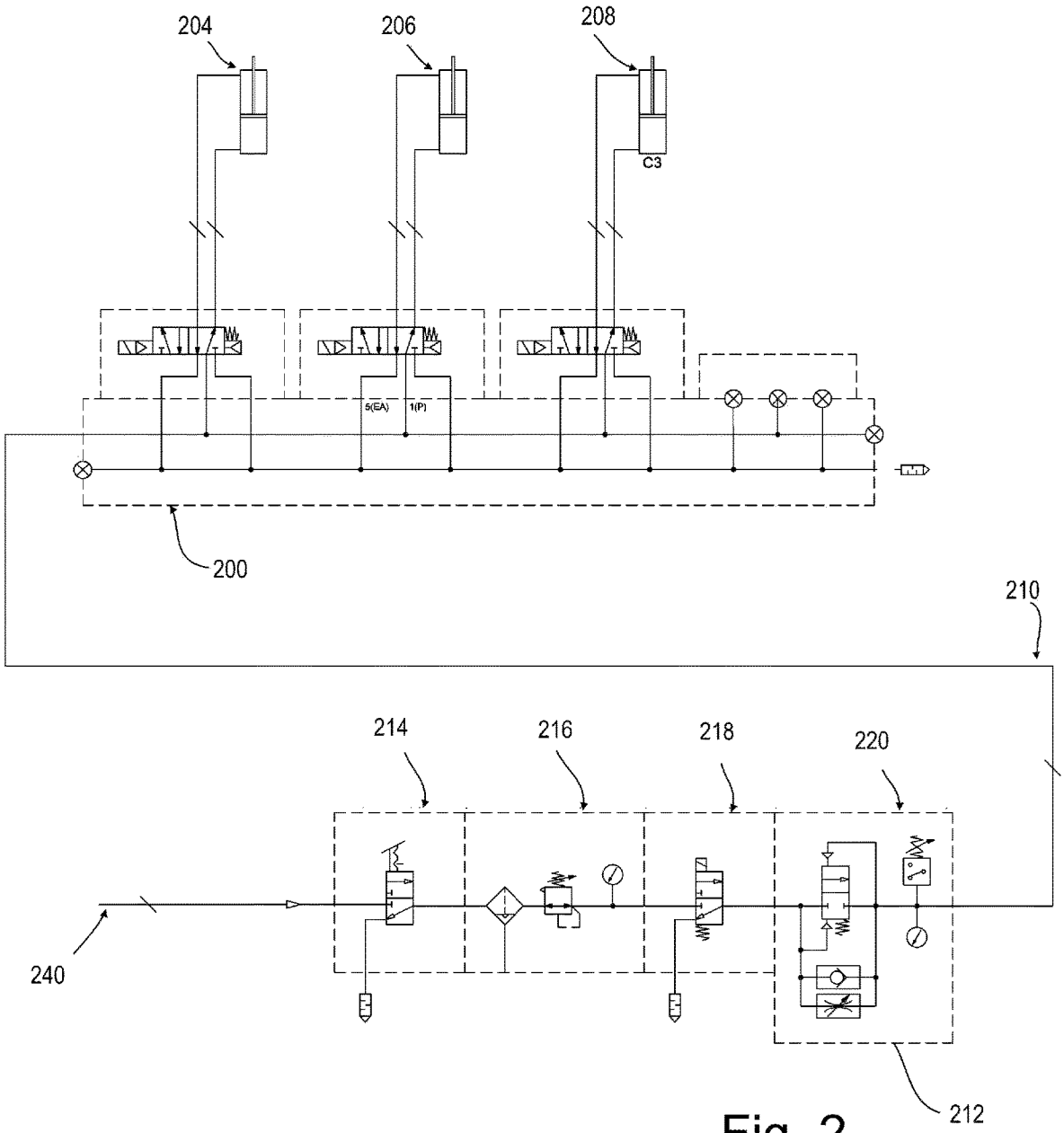
FIG. 2 is a circuit diagram of one example of the disclosed apparatus.
Figure 3:
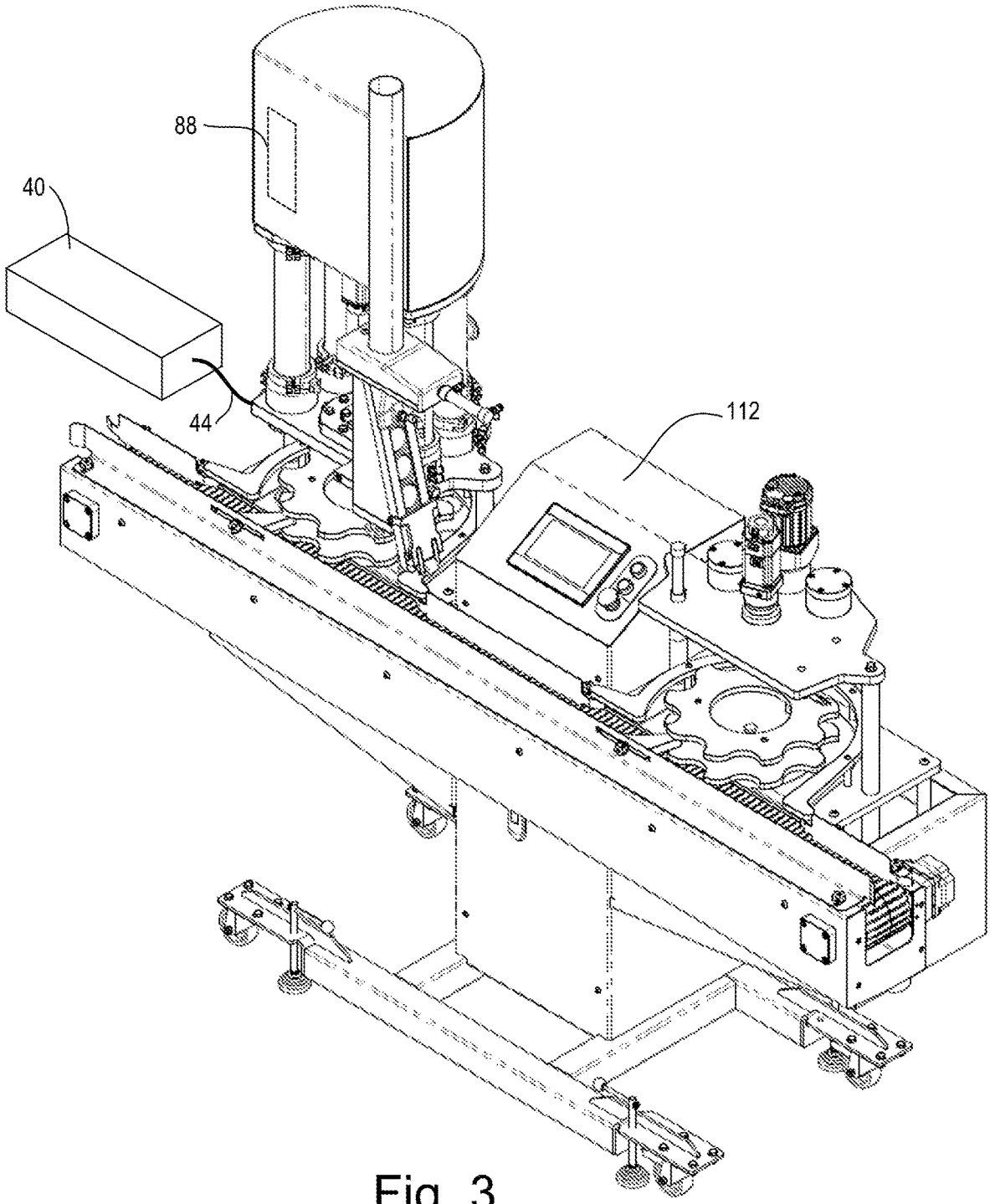
FIG. 3 is an environmental view showing the example of FIG. 1 along with other components of a station.

Looking to FIG. 2 is shown one example of a schematic of the apparatus shown in FIG. 3. This apparatus shows a common valve manifold 200 with sensors 202, as well as actuators for a filling station container lifter 204, a lid separator 206, and a seaming station container lifter 208. This common valve manifold 200 is connected by supply conduit to a valving assembly 212 including a manual lock switch 214, filter regulator 216, power supply on/off switch 218, soft start with pressure switch 220. Each of these was connected to a supply conduit 24 that were? connected to an air supply (source).

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept. The invention illustratively disclosed herein suitably may be practiced in the absence of any element which is not specifically disclosed herein.

The invention claimed is:

1. A fluid fill piston pump device comprising:

a piston chamber comprising an inner surface;

an oscillating piston having an outer surface forming a sliding seal to the inner surface of the piston chamber;

the oscillating piston separating the piston chamber into a gas chamber and a fluid chamber;

an external source of fill fluid connected via a fill fluid conduit to the fluid chamber;

a releasable sealing surface between the fluid chamber and a fluid container forming a fluid seal to the fluid container;

a container fill conduit connecting the fluid chamber and the fluid container;

a fluid fill valve configured to close the container fill conduit as the oscillating piston is increasing the volume of the fluid chamber;

a gas conduit connecting the gas chamber and the fluid container;

a gas valve selectively configured to open the gas conduit as the oscillating piston is increasing the volume of the gas chamber;

a source of inert gas;

a purge gas conduit connecting the source of inert gas and the gas chamber; and a purge gas valve selectively configured to close the purge gas conduit.

2. The fluid fill device as recited in claim 1 comprising a selectively closeable gas vent near an upper edge of the fluid chamber.

3. The fluid fill device as recited in claim 2 comprising a piston shaft extending from the oscillating piston to a piston actuator.

4. The fluid fill device as recited in claim 3 wherein the gas vent extends through the piston shaft.

5. The fluid fill device as recited in claim 2 comprising a selectively closeable gas vent valve.

6. The fluid fill device as recited in claim 5 wherein the selectively closeable gas vent valve comprises an electronic actuator.

7. The fluid fill device as recited in claim 1 wherein the fluid valve is a pressure actuated spring valve with a normally closed position.

8. The fluid fill device as recited in claim 1 wherein the gas valve comprises an electronic actuator.

* * * * *